US007874038B2

(12) United States Patent
Wen et al.

(10) Patent No.: US 7,874,038 B2
(45) Date of Patent: Jan. 25, 2011

(54) AIR GUN EQUIPMENT FOR CLEANING WORKPIECES

(75) Inventors: Qiang Wen, Shenzhen (CN); Hao Yu, Shenzhen (CN); Luo-Jie Zheng, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 477 days.

(21) Appl. No.: 11/964,805

(22) Filed: Dec. 27, 2007

(65) Prior Publication Data

US 2009/0056067 A1 Mar. 5, 2009

(30) Foreign Application Priority Data

Aug. 31, 2007 (CN) ..... 2007 1 0076765

(51) Int. Cl.
*A47L 5/00* (2006.01)

(52) U.S. Cl. ..... 15/319; 15/339; 15/405

(58) Field of Classification Search ..... 15/405, 15/300.1, 316.1, 330, 345, 319, 339, 307, 15/354

See application file for complete search history.

(56) References Cited

U.S. PATENT DOCUMENTS 5,755,043 A * 5/1998 Belanger et al. ..... 34/666
7,150,112 B2 * 12/2006 Faytlin ..... 34/666

* cited by examiner

*Primary Examiner*—Dung Van Nguyen
(74) *Attorney, Agent, or Firm*—Jeffrey T. Knapp

(57) ABSTRACT

An air gun equipment (10) for cleaning workpieces includes an air gun (20), a switch (50) connected to the air gun and an air source by pipes (206, 70), and a sensor (30) fixed on the air gun. The switch is controlled by an output signal from the sensor to control the flow of air from the air source to the air gun.

16 Claims, 3 Drawing Sheets

AIR GUN EQUIPMENT FOR CLEANING WORKPIECES

BACKGROUND OF THE INVENTION

1. Field of the Invention

The present invention generally relates to air gun equipments, and specifically to an air gun equipment configured (i.e., structured and arranged) for cleaning workpieces effectively.

2. Description of Related Art

During the manufacturing, workpieces (e.g. housing and mobile phones and printed circuit board) are often being exposed to contamination such as dust. Air guns are widely used as s tool for cleaning workpieces. A typical air gun includes a head and a switch connected to an air source. During a cleaning process, each head of the air gun faces one workpiece. The switch is turned on to project the compressed air form the air source thereby cleaning the dust on the workpiece. Then the cleaned workpiece is removed and a new workpiece is placed in front of the head for cleaning.

However, during such a cleaning process, the switch of the air gun is constantly on. Thus, the air gun works continuously to produce much noise and the air source does not get effective use.

Therefore, a new air gun equipment is desired in order to overcome the above-described problems.

SUMMARY

In one aspect thereof, an air gun equipment for cleaning workpieces includes an air gun, a switch connected to the air gun and an air source by pipes, and a sensor fixed on the air gun. The switch is controlled by an output signal from the sensor to control the flow of air from the air source to the air gun.

Other advantages and novel features of the embodiments will become more apparent from the following detailed description thereof, when taken in conjunction with the accompanying drawings.

BRIEF DESCRIPTION OF THE DRAWINGS

Many aspects of the present air gun equipment can be better understood with reference to the following drawings. The components in the drawings are not necessarily drawn to scale, the emphasis instead being placed upon clearly illustrating the principles of the present air gun equipment and its potential applications. Moreover, in the drawings, like reference numerals designate corresponding parts throughout the several views, in which.

DETAILED DESCRIPTION OF THE EMBODIMENTS

Figure 1:
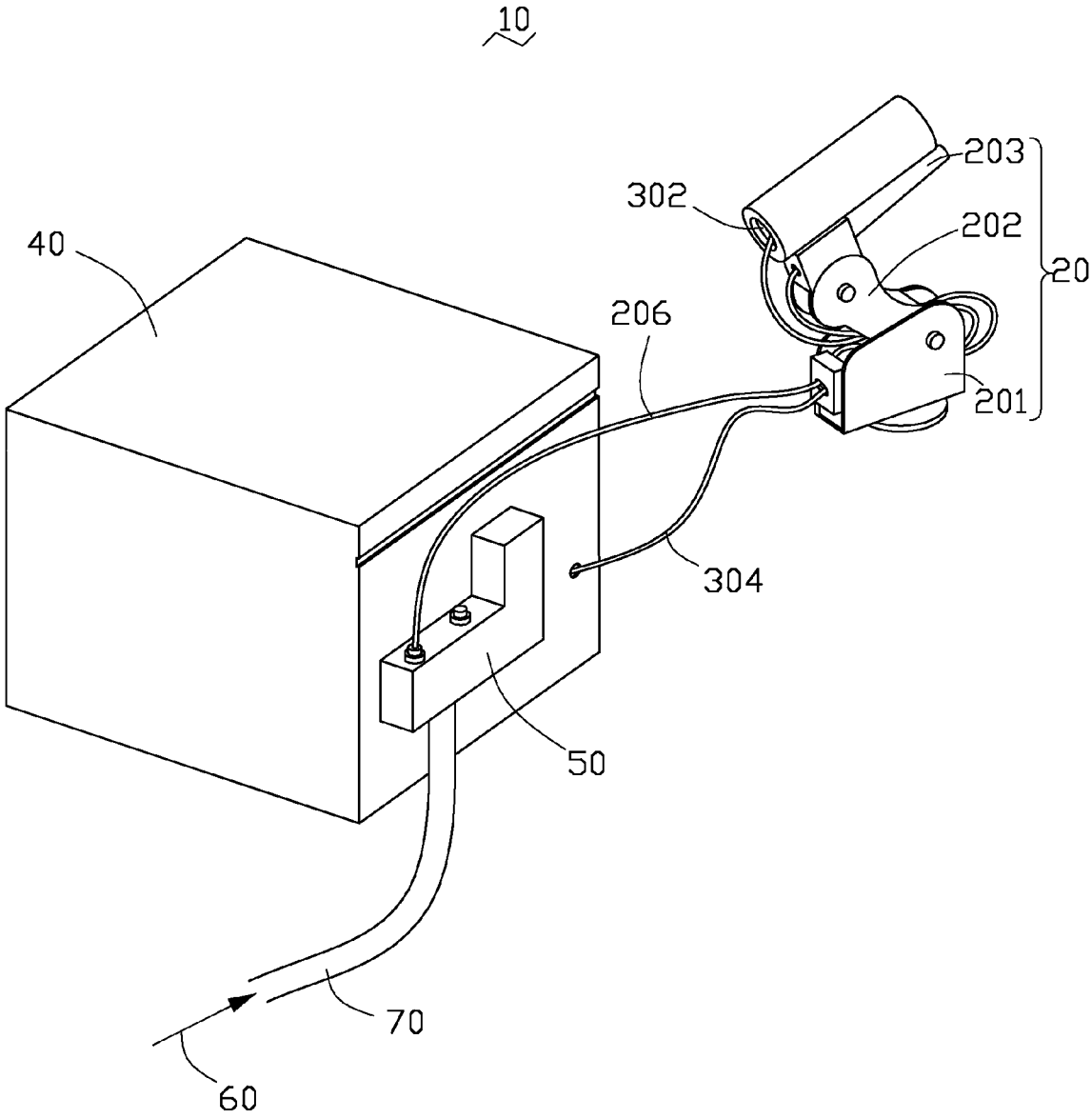
FIG. 1 is an isometric view of an air gun equipment, in accordance with a present embodiment.

Referring to the drawings in detail, FIG. 1 shows an air gun equipment 10 in accordance with a present embodiment. The air gun equipment 10 is configured for cleaning workpieces such as housings of mobile phones and printed circuit boards. Also referring to FIG. 2, the air gun equipment 10 includes an air gun 20, a sensor module 30 fixed on the air gun 20, a box 40, and a switch 50 fixed on the box 40. The box 40 electronically connects the sensor module 30. The switch 50 interconnects the air gun 20 to an air source 60 by pipes 206, 70.

Figure 2:
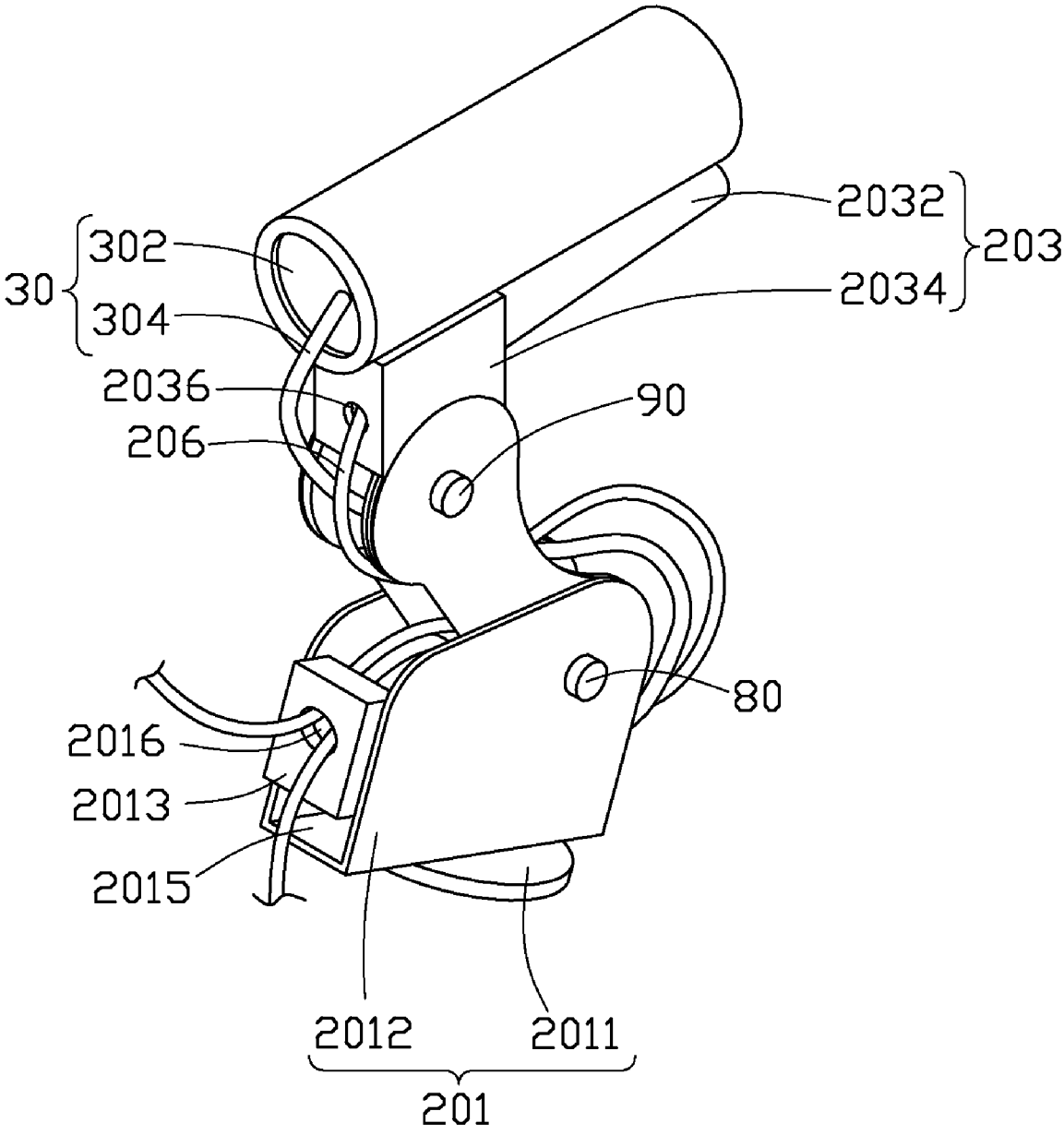
FIG. 2 is an enlarged, isometric view of the air gun and the sensor module of the air gun equipment shown in FIG. 1.

Further referring to FIGS. 1 and 2, the air gun 20 includes a base 201, a connecting member 202, and a head 203 rotatably connected to the base 201 with the connecting member 202. The base 201 includes a positioning disk 2011, a holding member 2012 fixed on the positioning disk 2011, and a block 2013 attached to one end of the holding portion 2012. The positioning disk 2011 is a magnet. The holding member 2012 is U-shaped and defines a cavity 2015 therein. The block 2013 defines a guiding hole 2016 through a center thereof. The head 203 has a projection portion 2032 and a mounting portion 2034. The projection portion 2032 is a substantially hollow cone in shape. The mounting portion 2034 is a substantially cuboid in shape. The projection portion 2032 is fixed to one side of the mounting portion 2034. The connecting member 202 has one end rotatably received in the cavity 2015 of the holding member 2012 by a pin 80 and the other end rotatably connected to the mounting portion 2034 of the head 203 by a pin 90. The mounting portion 2034 defines a channel 2036 therethrough communicating with the projection portion 2032.

The sensor module 30 includes a photoelectric sensor 302 and a wire 304 connected to the photoelectric sensor 302. The photoelectric sensor 302 is fixed to the air gun 20 and configured for sensing whether there is a workpiece located in front of the head 203 or not. The wire 304 travels through the cavity 2015 of the base 201 and the guiding hole 2016 of the base 201.

Figure 3:
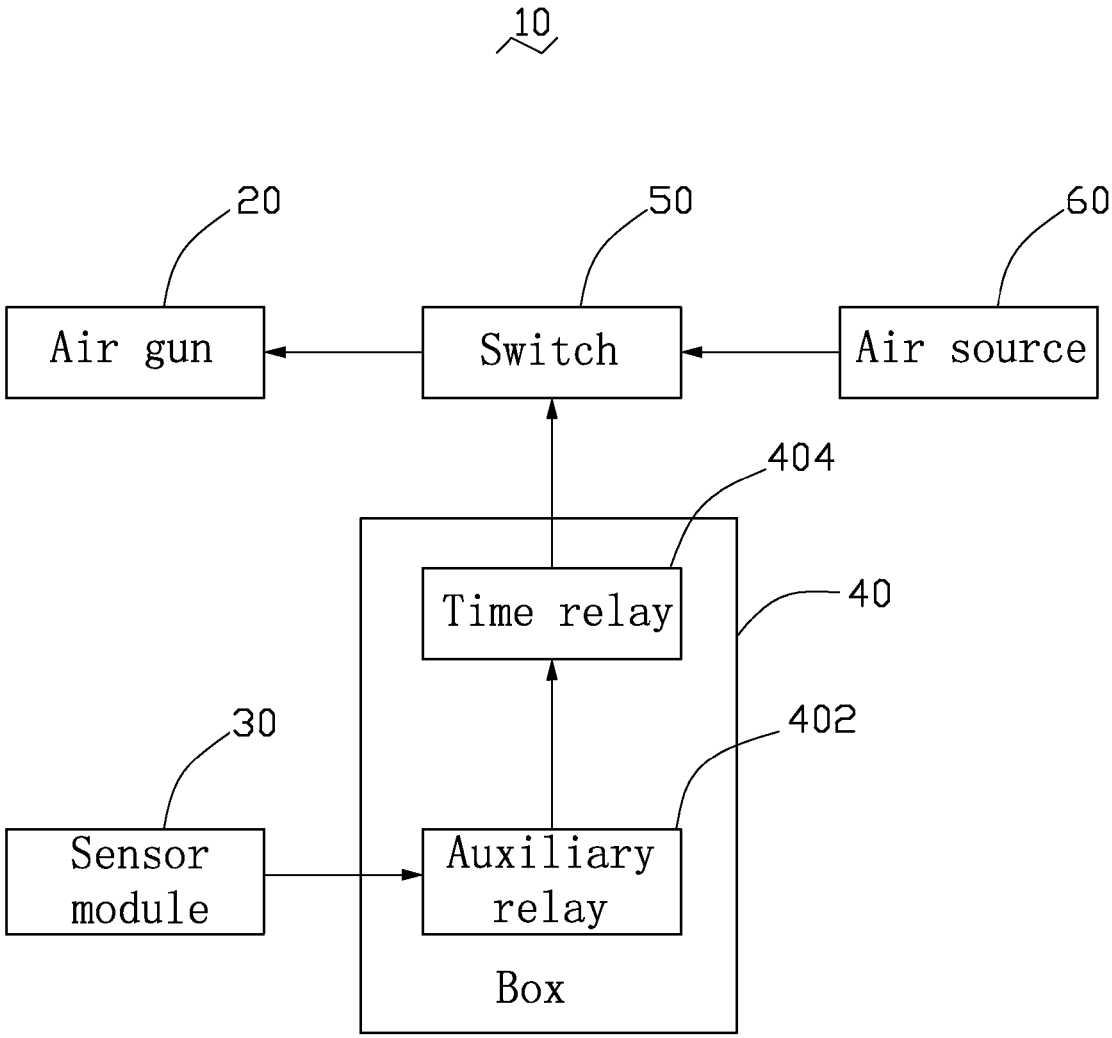
FIG. 3 is a schematic diagram of the air gun equipment shown in FIG. 1.

Also referring to FIG. 3, the box 40 is made of metal materials and contains an auxiliary relay 402 and a time relay 404 therein. The auxiliary relay 402 is electronically connected to the time relay 404. The auxiliary relay 402 is electronically connected to the photoelectric sensor 302 of the sensor module 30 by the wire 304. The auxiliary relay 402 is triggered by an output signal from the photoelectric sensor 302.

The switch 50 is an electromagnetic valve. The head 203 of the air gun 20 is connected to the switch 50 by the pipe 206. The pipe 206 travels through the guiding hole 2016 and the cavity 2015 of the base 201 and has one end received in the channel 2036 of the head 203. An air source 60 is connected to the switch 50 by a pipe 70. The switch 50 is configured for controlling the flow of air from the air source 60 to the air gun 20. The switch 50 is electrically connected to the time relay 404 and is controlled to turn on by an output signal from the time relay 404.

In use, when the head 203 of the air gun 20 faces towards the workpiece, the sensor 302 senses the workpiece and generates an output signal. The output signal generated from the sensor 302 is then transmitted to the auxiliary relay 402 by the wire 304. The time relay 404 is triggered by the auxiliary relay 402 to work for a predetermined time. The switch 50 is turned on by the time relay 404 and the compressed air is transmitted to the head 203 from the air source 60 during the predetermined time. The air outputted from the head 203 cleans the workpiece. When the cleaned workpiece is moved away, the sensor 302 stops working and correspondingly, the auxiliary relay 402 and the time relay 404 stop working. The switch 50 is then turned off to stop transmission of air from the air source 60 to the head 203. When the air gun 20 is not in working state, the air gun 20 may be placed on the box 40 by the magnetic engagement between the positioning disk 2011 and the box 40.

It should be understood that the auxiliary relay 402 may be omitted and the sensor module 30 can be electronically connected to the switch 50 by the time relay 404. Further, the time relay 404 may be omitted and the sensor module 30 can be electronically connected to the switch 50 by the wire 304. The switch 50 can be directly controlled by signals output from the sensor module 30.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An air gun equipment for cleaning workpieces, comprising:

an air gun including a magnetic positioning disk;

a switch connected to the air gun and an air source by pipes, the switch controlling the flow of air from the air source to the air gun;

a sensor module configured for detecting a workpiece within a predetermined distance from the air gun and creating an output signal to control the switch and allow air flow if the workpiece is detected; and a metal box electronically connecting the sensor module to the switch, the air gun being positioned on the metal box using the magnetic positioning disk when the air gun is not being used.

2. The air gun equipment as claimed in claim 1, wherein the sensor module includes a photoelectric sensor configured for sensing whether there is a workpiece located in front of the air gun.

3. The air gun equipment as claimed in claim 2, wherein the sensor module also includes a wire, the sensor being fixed to the air gun, and the wire electronically connecting the sensor to the switch.

4. The air gun equipment as claimed in claim 2, wherein the sensor is cylindrical in shape.

5. The air gun equipment as claimed in claim 1, wherein the metal box contains a time relay therein, the time relay being triggered by the sensor module, and the switch being controlled by the time relay.

6. The air gun equipment as claimed in claim 5, wherein the metal box further contains an auxiliary relay electronically interconnecting the sensor module and the time relay.

7. The air gun equipment as claimed in claim 1, wherein the air gun includes a base, and the magnetic positioning disk is part of the base.

8. The air gun equipment as claimed in claim 7, wherein the base further includes a U-shaped holding member fixed on the magnetic positioning disk.

9. The air gun equipment as claimed in claim 8, wherein the air gun includes a head and a connecting member rotatably connecting the head to the base.

10. The air gun equipment as claimed in claim 8, wherein the base further includes a block defining a guiding hole therethrough, and the block being fixed to one end of the holding member.

11. The air gun equipment as claimed in claim 1, wherein the switch is an electromagnetic valve.

12. An air gun equipment for cleaning workpieces, comprising:

an air gun including a magnetic positioning disk;

a metal box, an electromagnetic valve fixed on the metal box, the electromagnetic valve connected to the air gun and an air source by pipes, the magnetic positioning disk attaching the air gun to the metal box when the air gun is not being used;

a photoelectric sensor module configured for sending an output signal to the electromagnetic valve, thereby controlling the electromagnetic valve to activate the flow of air from the air source to the air gun.

13. The air gun equipment as claimed in claim 12, further comprising a time relay which is triggered by the photoelectric sensor module to control the electromagnetic valve.

14. The air gun equipment as claimed in claim 12, wherein the air gun further comprises a holding member, a head and a connecting member rotatably connecting the head to the holding member, and the magnetic positioning disk is positioned at one end of the holding member.

15. The air gun equipment as claimed in claim 14, wherein the holding member is U-shaped.

16. An air gun equipment for cleaning workpieces, comprising:

an air gun including a base, a head and a connecting member rotatably connecting the head to the base;

a box including a switch, the switch connected to the air gun and an air source by pipes, the switch controlling the flow of air from the air source to the air gun, the base attached to the metal box by magnetism when the air gun is not being used; and a sensor module configured for detecting a workpiece within a predetermined distance from the air gun and if the workpiece is detected creating an output signal to control the switch and allow air flow.

* * * * *